US009650787B2

(12) United States Patent
Montojo et al.

(10) Patent No.: US 9,650,787 B2
(45) Date of Patent: May 16, 2017

(54) SINGLE LAYER FOLDABLE REINFORCED BULLNOSE HIP AND RIDGE CAP SHINGLE

(71) Applicant: Building Materials Investment Corporation, Dallas, TX (US)

(72) Inventors: Jeffrey Montojo, Chino Hills, CA (US); Derek Petcher, Rancho Cucamonga, CA (US); Jack Martinez, Yucaipa, CA (US); Seamus Fahey, Rancho Cucamonga, CA (US); Roy Ballesteros, Fontana, CA (US); Harlan Wayne Selway, Huntington Beach, CA (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 14/983,990

(22) Filed: Dec. 30, 2015

(65) Prior Publication Data

US 2016/0186438 A1 Jun. 30, 2016

Related U.S. Application Data

(60) Provisional application No. 62/098,914, filed on Dec. 31, 2014.

(51) Int. Cl.
*E04D 1/28* (2006.01)
*E04D 1/30* (2006.01)

(52) U.S. Cl.
CPC ..... *E04D 1/30* (2013.01); *E04D 2001/305* (2013.01)

(58) Field of Classification Search
CPC ..... E04D 1/30; E04D 2001/305
See application file for complete search history.

(56) References Cited

U.S. PATENT DOCUMENTS

| | | | | | |
|---|---|---|---|---|---|
| 1,640,806 | A | | 8/1927 | Ritter | |
| 1,685,999 | A | | 10/1928 | Harris | |
| 1,771,990 | A | | 8/1930 | Bergner | |
| 2,031,993 | A | | 2/1936 | Varden | |
| 3,913,294 | A | * | 10/1975 | Freiborg | E04D 1/30 52/518 |
| 5,247,771 | A | * | 9/1993 | Poplin | E04D 1/30 52/518 |
| 5,377,459 | A | | 1/1995 | Freiborg | |
| 5,471,801 | A | * | 12/1995 | Kupczyk | E04D 1/30 52/518 |

(Continued)

*Primary Examiner* — Jeanette E Chapman
(74) *Attorney, Agent, or Firm* — Womble Carlyle Sandridge & Rice LLP

(57) ABSTRACT

A single layer foldable reinforced bullnose hip and ridge cap shingle is cut from a single layer web of shingle material. The hip and ridge cap shingle includes an exposed portion, a tapered portion, and a portion in between that will be folded to form a bullnose edge. Two spaced apart perforated fold lines extend transversely across the shingle and two spaced apart transversely extending strips of reinforcing scrim material flank the perforated fold lines. To form a bullnose hip or ridge cap shingle, the shingle is folded first along one of the perforated fold lines and again along the other perforated fold line. This creates an exposed edge portion that is four layers thick and this extreme edge takes on a pleasant rounded bullnose appearance covered with granules. The reinforcing scrim is located at the edge and reinforces the bullnose edge to prevent cracking at the fold.

11 Claims, 5 Drawing Sheets

(56) References Cited

U.S. PATENT DOCUMENTS

| | | | | |
|---|---|---|---|---|
| 5,916,103 | A * | 6/1999 | Roberts | E04D 1/26 52/105 |
| 7,823,334 | B2 | 11/2010 | Jolitz | |
| 8,281,520 | B2 * | 10/2012 | Quaranta | E04D 1/30 52/518 |
| 8,613,165 | B2 * | 12/2013 | Bleil | E04D 1/20 156/204 |
| 2006/0201094 | A1 | 9/2006 | Lassiter | |
| 2007/0011978 | A1 * | 1/2007 | Kalkanoglu | B32B 5/24 52/518 |
| 2010/0212246 | A1 * | 8/2010 | Grubka | B32B 37/24 52/540 |
| 2015/0240496 | A1 * | 8/2015 | Grubka | E04D 1/20 428/40.3 |

* cited by examiner

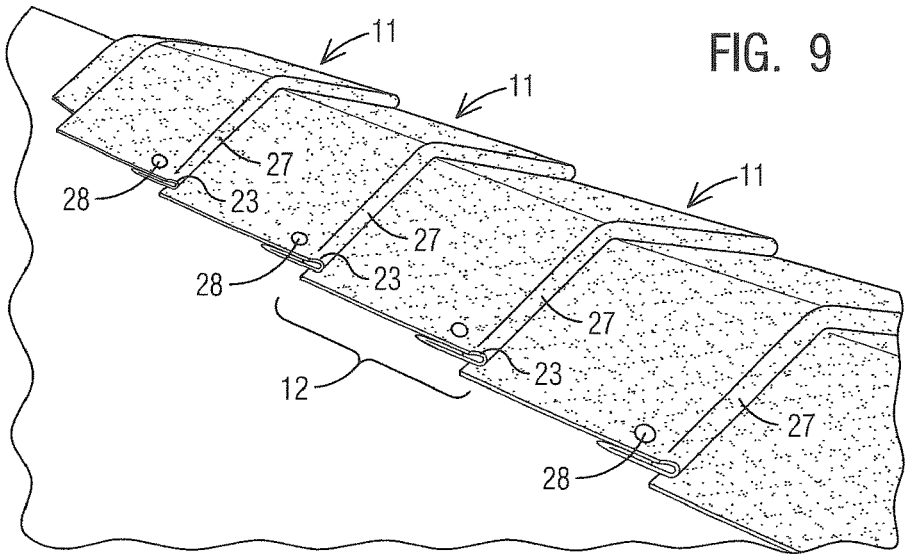
FIG. 9
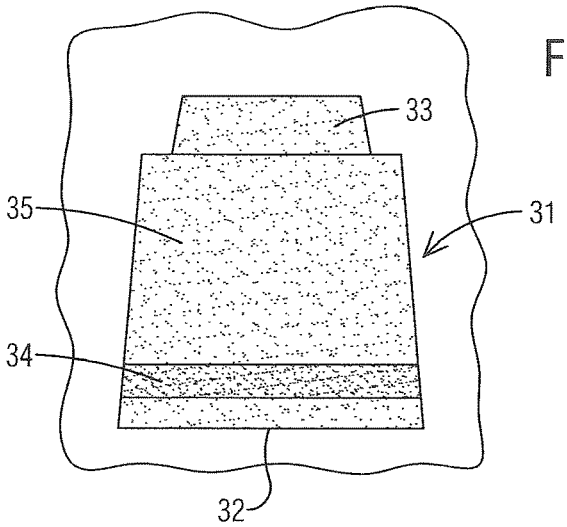
FIG. 10
FIG. 11
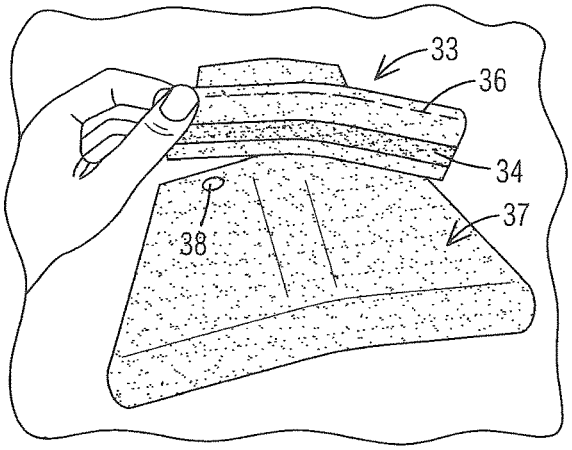

SINGLE LAYER FOLDABLE REINFORCED BULLNOSE HIP AND RIDGE CAP SHINGLE

REFERENCE TO RELATED APPLICATION

Priority is hereby claimed to the filing date of U.S. provisional patent application 62/098,914 filed on Dec. 31, 2014, the entire content of which is hereby incorporated by reference.

TECHNICAL FIELD

This disclosure relates generally to roofing shingles and more specifically to hip cap and ridge cap shingles.

BACKGROUND

Ridge cap and hip cap shingles are commonly used by roofers to cover the ridges and/or hips of a residential roof. Such shingles overlap one another along a ridge or hip and help shed water away from the ridge or cap. One type of ridge and hip cap shingle is the so-called bullnose ridge and hip cap shingle. Bullnose shingles generally are characterized by an exposed edge that is thicker than normal to give the appearance of texture, thickness, and depth along the ridges and hips of a roof. Prior art bullnose ridge and hip shingles have suffered from a variety of shortcomings inherent in their respective designs. For example, some prior art ridge and hip cap shingles obtain a thicker exposed edge simply by stacking and gluing together two or three layers of shingle material along the exposed edges. This is undesirable for a number of reasons, including the resulting raw edges of shingle material that are considered unsightly by some, the difficulty of manufacturing requiring additional special steps to stack shingle material at the edges, and the excessive use of shingle material. Other prior art bullnose ridge and hip shingles are foldable to form a multi-layer exposed edge, but these shingles are prone to cracking at their edges, particularly in cold or other extreme weather environments, due to the stress at the folds. In addition, these prior art folded ridge and hip cap shingles can be difficult to install in a reliable and repeatable way along the ridges and hips of a roof.

A need exists for a foldable ridge and hip cap shingle that makes efficient use of shingle material, that does not tend to crack along its folded edges in extreme weather, and that is virtually fool proof to erect and install along a ridge or hip of a roof. It is to the provision of such a ridge and hip cap shingle that the present invention is primarily directed.

SUMMARY

Briefly described, a single layer foldable reinforced bullnose hip and ridge cap shingle is cut from a single layer web of shingle stock previously coated with asphalt and covered with granules. The hip and ridge cap shingle has a substantially rectangular portion that is to be exposed when installed and a tapered portion that will be covered by another ridge cap shingle in an installation. Spaced apart transversely extending perforations form lines that extend transversely across the shingle at locations where the shingle is to be folded to form a thick bullnose edge. The perforated fold lines allow simple folding of the single layer shingle material to form a quadruple layer bullnose style edge on the exposed portion of the shingle. Transversely extending strips of reinforcing scrim material extend across the shingle on either side of the transverse fold lines. One of the strips of reinforcing scrim material is positioned such that it spans what becomes the folded bullnose edge of the shingle when folded. This reinforces the edge to inhibit cracking of the shingle material along the folded bullnose edge.

Thus, a single layer foldable reinforced bullnose hip and ridge cap shingle is disclosed that is cut from a single thickness web of shingle stock. This results in lower manufacturing cost and more efficient manufacturing due in part to the elimination of additional manufacturing steps to stack and adhere multiple layers of strips of shingle material at the exposed edge. When folded to form a bullnose style edge on the shingle, the entire exposed edge is formed of granule coated shingle stock, which is more visually appealing than the exposed cut edges of prior art bullnose shingle designs and more resistant to deterioration than cut edges. The perforated fold lines where the cap shingle is to be folded prior to installation make installation substantially fool proof and results in a neat consistent appearance from shingle to shingle. These and other aspects, features, and advantages of the hip and ridge cap shingle of this disclosure will become more apparent upon review of the detailed description set forth below taken in conjunction with the accompanying drawing figures, which are briefly described as follows.

BRIEF DESCRIPTION OF THE DRAWINGS

FIG. 9 is another perspective view showing a plurality of hip and ridge cap shingles of this disclosure installed along the ridge of a roof.

FIGS. 10 and 11 illustrate an alternate embodiment of the invention with a self-seal line positioned beneath the folded bullnose and a hidden nailing location.

DETAILED DESCRIPTION

Figure 1:
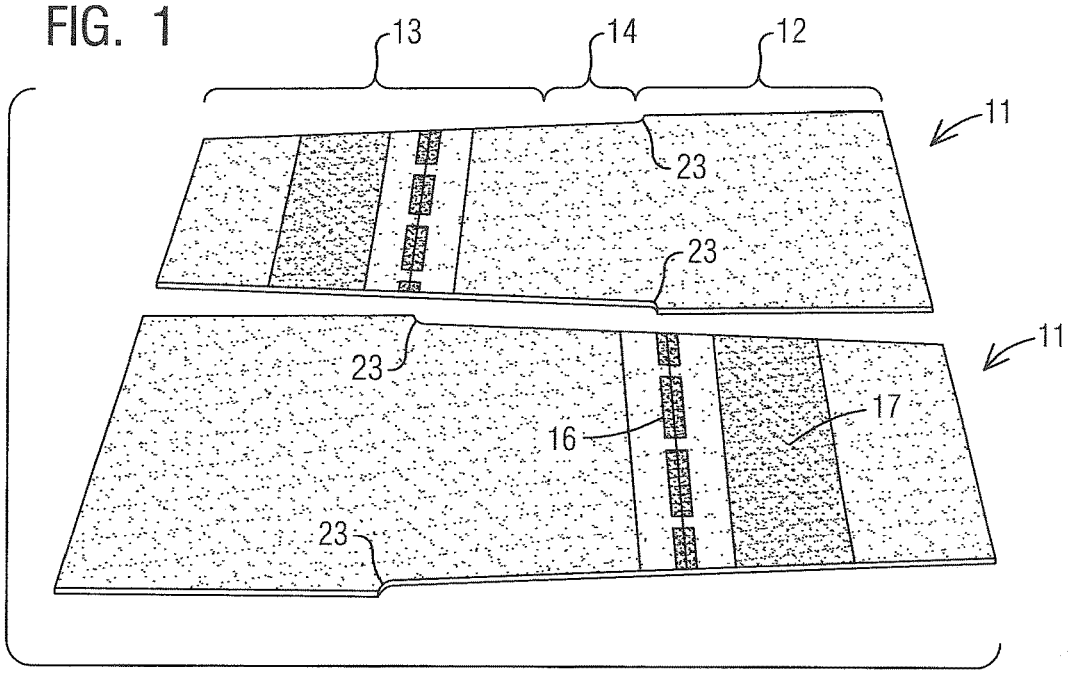
FIG. 1 is a perspective view of two hip and ridge cap shingles of this disclosure showing various portions thereof.

Reference will now be made to the attached drawing figures, wherein like reference numerals indicate like parts throughout the several views. FIG. 1 shows two unfolded hip and ridge cap shingles 11 turned in opposite directions and embodying principles of the invention in one preferred form. Each shingle 11 has an elongated body that is cut from single layer shingle stock. The body has a substantially rectangular front portion 12 that will be exposed when the shingle is folded and installed along a hip or ridge. A tapered back portion 13 extends rearwardly of the rectangular portion 12. A intermediate portion 14 between the rectangular portion 12 and the tapered portion 13 will become the folded bullnose edge of the shingle when the shingle is folded and installed. A self-seal strip 16 is printed transversely across the tapered portion 13. A ribbon of reinforcing scrim 17 extends laterally across the shingle behind the self-seal strip 16. Opposing notches 23 are formed on the sides of the shingle at the intersection of portions 12 and 14. An imaginary line drawn between the notches approximately defines the location of the bullnose edge that will be formed when the shingle is folded and installed. The substantially rectangular portion 12 and at least the portion 14 are covered with granules as is known in the art.

Figure 2:
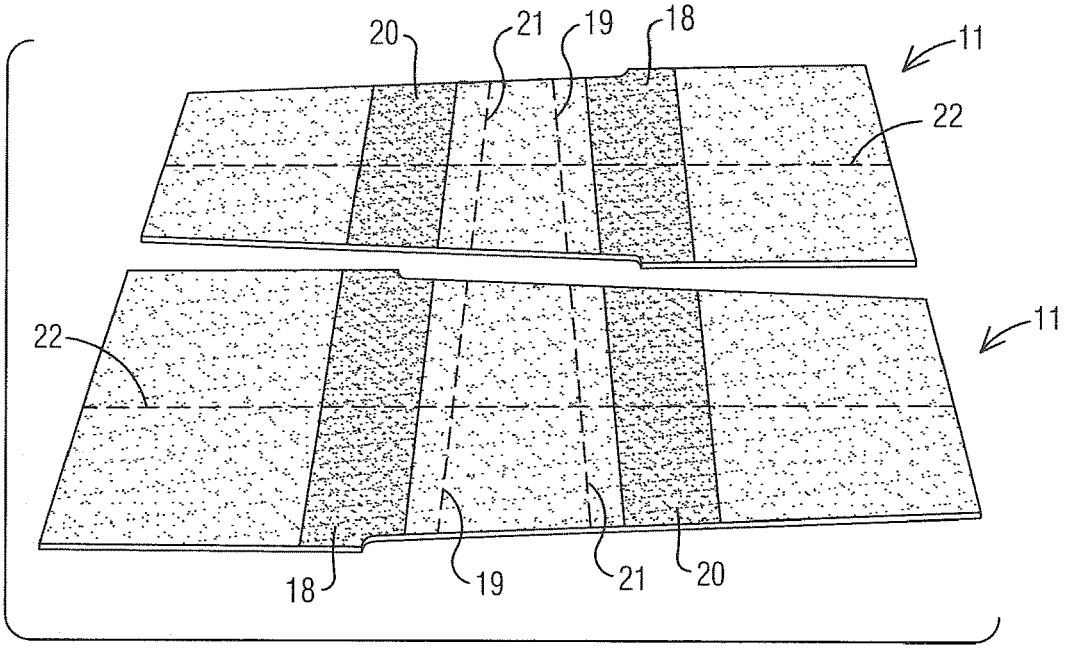
FIG. 2 is a perspective view of two hip and ridge cap shingles of this disclosure seen from the opposite side as that shown in FIG. 1.
Figure 3:
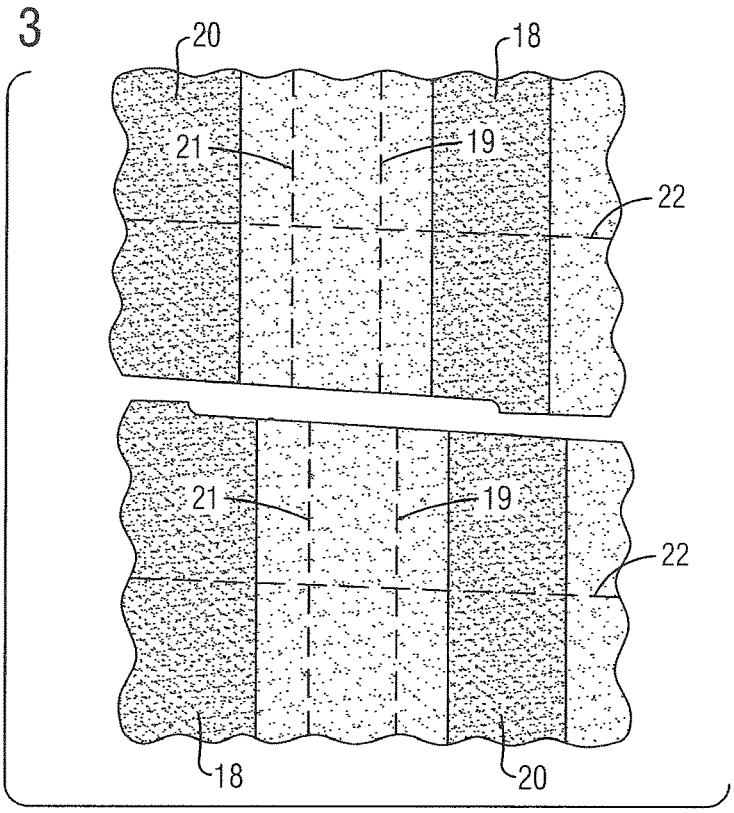
FIG. 3 is an enlarged plan view of part of FIG. 2 showing the perforated fold lines and the strips of reinforcing scrim material thereon.

FIG. 2 shows the shingles of FIG. 1 turned over to reveal the opposite sides of the shingles. A pair of spaced apart ribbons of reinforcing scrim material is applied to this side of the shingle extending transversely across the shingle. These comprise a first ribbon 18 and a second ribbon 20 that is rearwardly spaced from the first ribbon 18. The first reinforcing ribbon 18 has a width that extends on either side of a line between the notches 23. The second rearwardly spaced ribbon 20 has a width similar to that of the first ribbon 18. A first perforated fold line 19 is cut or otherwise formed transversely across the shingle just behind the first reinforcing ribbon 18. A second perforated fold line is formed rearwardly of the first fold line 19 just in front of the second ribbon 20. A longitudinally extending perforated fold line 22 also is cut or otherwise formed in this side of the shingle and substantially bisects the shingle. The perforated fold lines 19, 21, and 22 provide an installer a set of folding guides when the shingle is folded by the installer to form the bullnose, and folded longitudinally by the installer to fit over the ridge of a roof, as described in more detail below. FIG. 3 is an enlarged image of a portion of the shingles of FIG. 2 showing perhaps more clearly the perforated fold lines 19, 21, and 22 and the ribbons of reinforcing scrim material 18 and 20.

Figure 4:
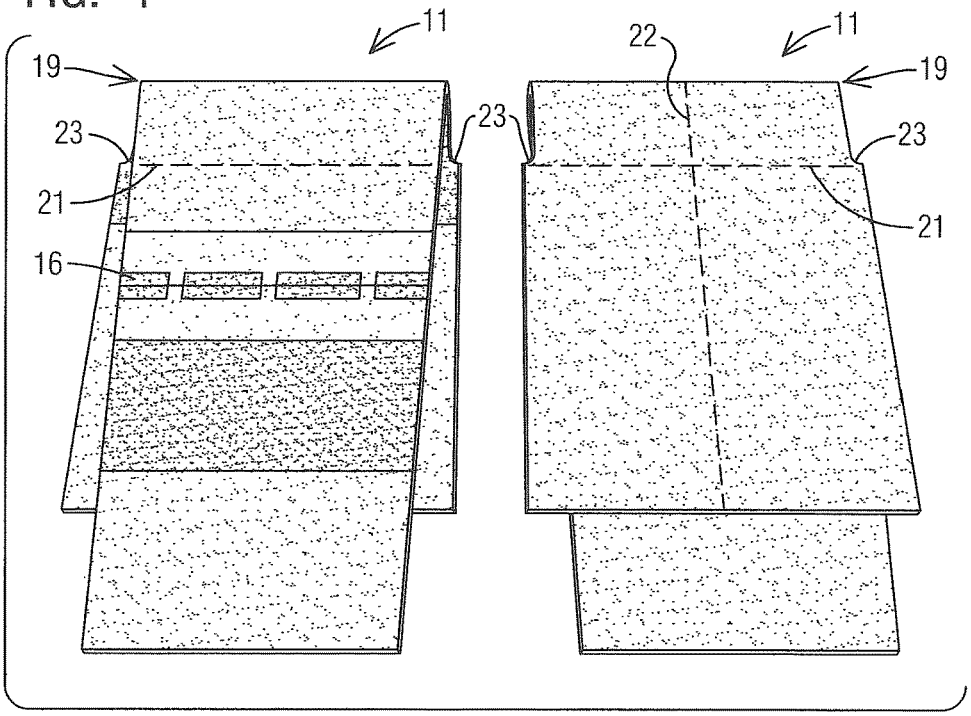
FIG. 4 illustrates the first of two folding steps necessary to create the folded bullnose edge of the hip and ridge cap shingle of this disclosure.

FIG. 4 illustrates the first folding step carried out by an installer to form a bullnose hip and ridge cap shingle prior to securing the shingle to a roof deck. The image on the left shows the underside of the folded shingle and the image on the right shows the upper or exposed side of the folded shingle. More specifically, the shingle is first folded along the first perforated fold line 19 so that the tapered portion 13 underlies the substantially rectangular portion 12. The transverse fold lines 19 and 21 are positioned so that the initial fold along the first fold line 19 substantially aligns the second fold line 21 with the notches 23 on the sides of the shingle. This, in turn, aligns the second fold line 21 approximately across the middle of the first reinforcing ribbon 18, as seen in the left image of FIG. 4.

Figure 5:
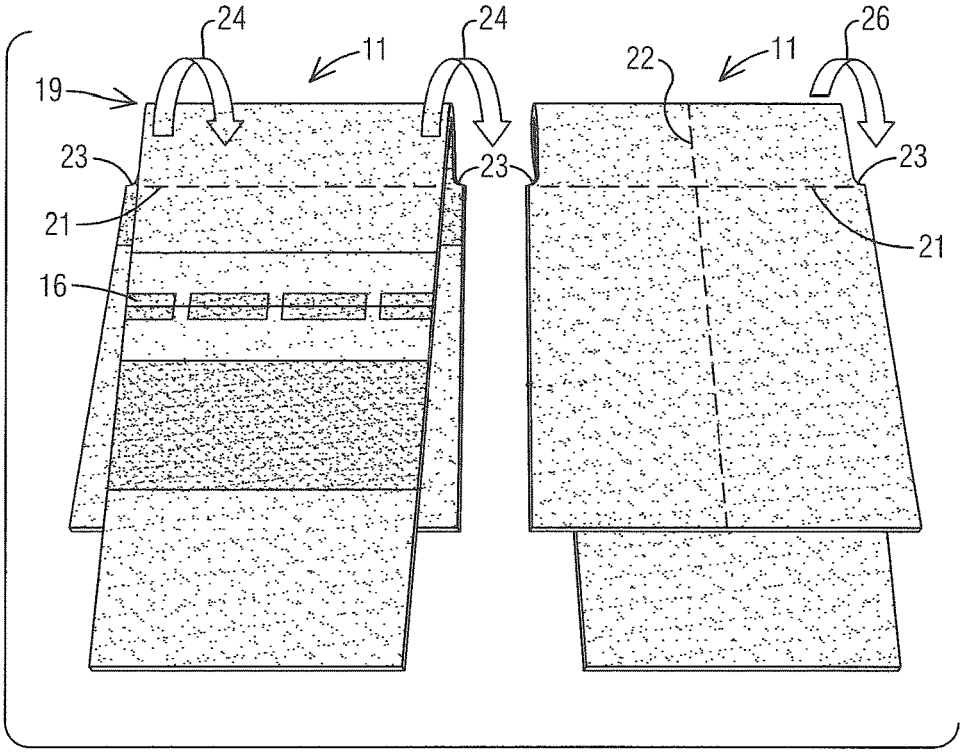
FIG. 5 illustrates the second of two folding steps necessary to create the folded bullnose edge of the hip and ridge cap shingle of this disclosure.

FIG. 5 illustrates the second folding step carried out by an installer to form the multi-layer bullnose at the forward edge of the exposed portion of the shingle. More specifically, the edge portion formed by the first folding step is folded under along the second perforated fold line 21 as indicated by arrows 24 and 26. This folding step forms what will become the exposed bullnose edge of the hip and ridge cap shingle when the shingle is attached to the hip or ridge of a roof. Significantly, this second folding step results in the first reinforcing ribbon 18 extending through and around the second fold and thus around the resulting bullnose edge of the shingle. The location of the first reinforcing ribbon 18 at the folded bullnose edge of the shingle provides significant resistance to cracking and other damage at the edge, which can occur especially in extreme climates such as bitter cold.

Figure 6:
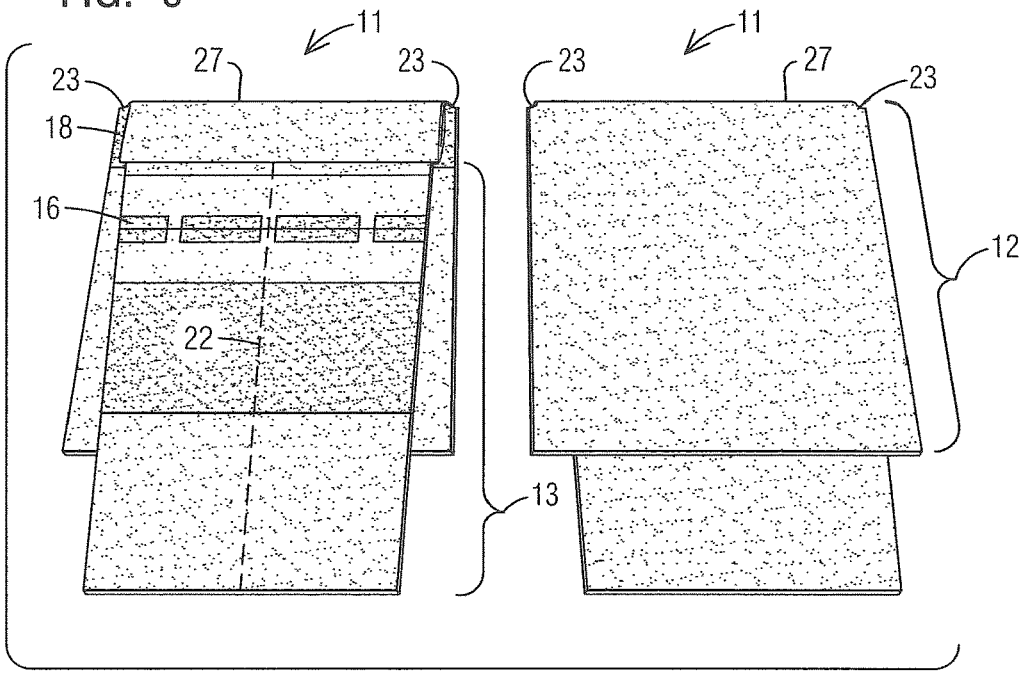
FIG. 6 illustrates the appearance of the hip and ridge cap shingle after the two folding steps are accomplished.
Figure 7:
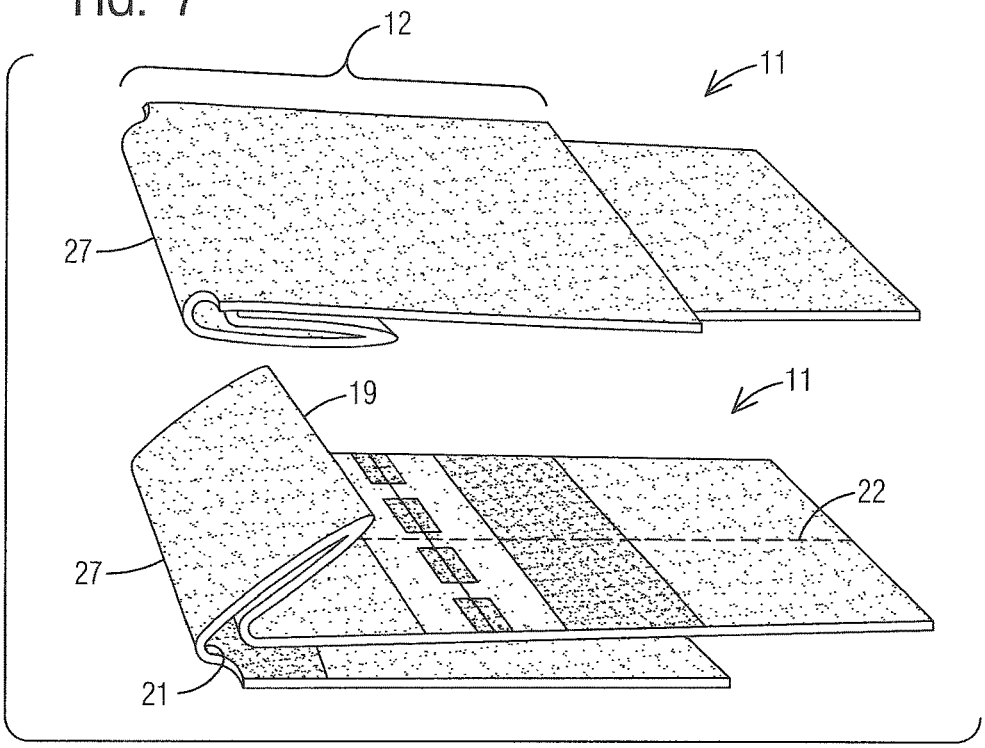
FIG. 7 is a side perspective close-up view of the hip and ridge cap shingle after the two folding steps are accomplished and illustrates the folded bullnose edge created by the folding.

FIG. 6 shows the hip and ridge cap shingle with the second fold having been completed. The underside of the folded shingle is shown on the left and the exposed upper side of the shingle is shown on the right. It will be seen that the two folding steps result in a four-layer forward edge portion of the shingle with the bullnose extending around the forward edge and the reinforcing scrim positioned to provide reinforcement to the forward edge. The location of the longitudinal fold line 22 provides a guide for the installer to fold the shingle longitudinally to conform to the angle of a ridge or hip along which the shingle is to be installed. FIG. 7 is an enlarged perspective view of the exposed edge portion of the folded shingle with the underside of the folded shingle in the foreground and the upper exposed side of the folded shingle in the background. The first fold along the first perforated fold line 19 is clearly shown in this figure as is the second fold along the second perforated fold line 21. The resulting bullnose edge 27, reinforced by the ribbon of reinforcing material 23, takes on a thick rounded shape that is architecturally pleasing on a roof and gives the appearance of a hip or ridge cap shingle that is much thicker than a traditional single layer shingle.

Figure 8:
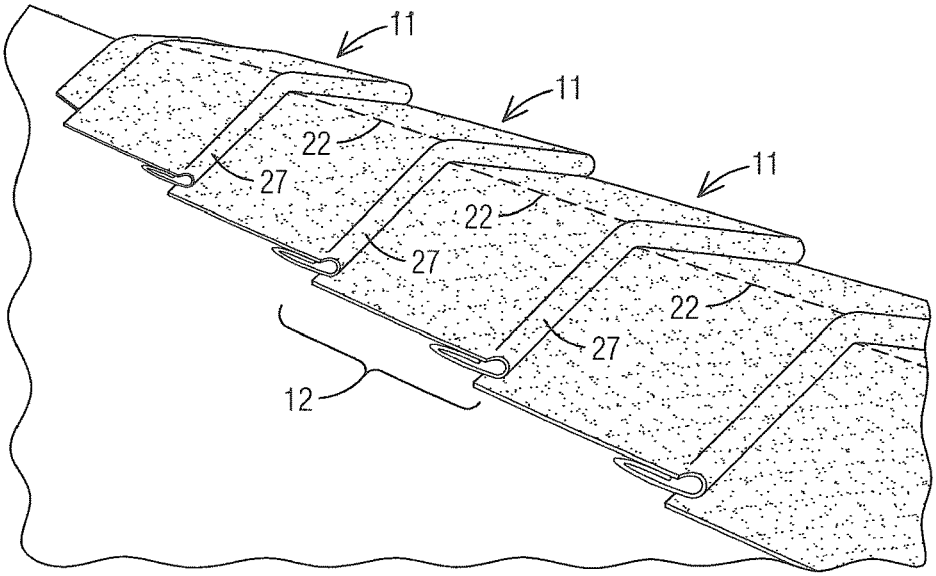
FIG. 8 is a perspective view showing a plurality of hip and ridge cap shingles of this disclosure folded along a longitudinal folding line and installed along the ridge of a roof.

FIG. 8 shows several hip and ridge cap shingles folded as described above and installed along the ridge of a roof. The bullnose edge of each shingle preferably overlaps a small part of the exposed portion 12 of the underlying shingle and the thick rounded bullnose provides architectural interest and the appearance of thickness or texture. The tapered portion of each shingle rests on underlying deck shingles and may be nailed or otherwise attached in place. Over time, the self-seal strip adheres to the underlying shingles to provide a permanent adhesive attachment. Each shingle is folded into a V-shape along the location of the longitudinal fold line 22 so that it conforms to the shape of the hip or ridge along which it is attached. FIG. 9 is another image of the hip and ridge cap shingles of this invention installed along the ridge of a roof. A roofing nail 28 is shown in this figure driven through the shingle and into the roof deck just behind the bullnose of the single. Supplemental attachment in this way may provide a more secure installation, but also may be eliminated if desired.

FIGS. 10 and 11 show an alternate embodiment of the hip and ridge cap shingle of this invention. In FIG. 10, the shingle 31 is shown folded along its first perforated fold line 32 with the tapered portion 33 disposed beneath the generally rectangular exposed portion 35. In this embodiment, a ribbon of self-seal material 34 is applied just behind the first fold line. The self-seal material may be asphalt or another adhesive as is known in the art. The placement and size of the self-seal line 34 is such that it will reside beneath the bullnose formed with the shingle 31 is folded again along its second fold line. This is illustrated in FIG. 11, where the hip and ridge cap shingle 33 is shown folded along its second perforated fold line 36 and being installed in overlapping relationship with a previously installed cap shingle 37. When the hip and ridge cap shingle is laid atop the previously installed shingle 37, the self-seal line resides between the two shingles as shown. As the roof heats in the sun, the self-seal line bonds the two shingles together for a secure installation. Further, the self-seal line 34 preferably is positioned to cover the heads of roofing nails 38 so that the nail heads are hidden between successive shingles and are sealed by the material of the self-seal line.

It will be seen that a goal of the hip and ridge cap shingle of this invention is to create a multi-purpose, high profile, bullnose ridge or hip cap shingle that is more cost effective, more rugged, and more visually appealing than prior art products. Additionally, the simpler single layer design allows for more efficient manufacturing without the additional steps required in the fabrication of prior art products. The reinforcing material at the folded edge increases the durability of the ridge cap in extreme environments. The hip and ridge cap shingle of this invention is multi-purpose since the product can be installed using an array of methods depending on the desired appearance on a roof. The perforated fold lines of the shingle provide folding guides that are virtually fool proof, resulting in consistent and correct installation every time.

The invention has been described in terms and within the context of preferred embodiments considered by the inventors to represent the best mode of carrying out the invention. It will be appreciated by the skilled artisan, however, that numerous additions, deletions, and modifications, both subtle and gross, may be made to the illustrated embodiments without departing from the spirit and scope of the invention, which is delineated only by the claims.

What is claimed is:

1. A hip or ridge cap shingle comprising:

a shingle blank having an elongated body with a bottom side, a top side, a front portion, a back portion, and an intermediate portion between the front portion and the back portion;

a first fold line extending transversely across the shingle blank allowing the front portion to be folded along the first fold line at least partially beneath the back portion forming a two-layer forward edge portion;

a second fold line extending transversely across the shingle blank allowing the two layer forward edge portion to be folded at least partially beneath the intermediate portion forming a four-layer forward edge portion with a two-layer bullnose edge;

a ribbon of reinforcing material having a width and extending transversely across the elongated body of the shingle blank;

the ribbon of reinforcing material being positioned on the shingle to extend around the bullnose edge of the four-layer forward edge portion to provide support and crack resistance along the bullnose edge.

2. A hip or ridge cap shingle as claimed in claim 1 wherein the four-layer folded forward edge portion is exposed when the shingle is installed with a plurality of like shingles along a ridge or a hip of a roof.

3. A hip or ridge cap shingle as claimed in claim 1 wherein the front portion is substantially rectangular in shape.

4. A hip or ridge cap shingle as claimed in claim 3 wherein the back portion is tapered.

5. A hip or ridge cap shingle as claimed in claim 4 wherein the intermediate portion is tapered.

6. A hip or ridge cap shingle as claimed in claim 1 further comprising notches formed along opposing sides of the shingle body at the intersection of the front portion and the intermediate portion.

7. A hip or ridge cap shingle as claimed in claim 6 wherein the notches are located substantially at the location of the bullnose edge when the shingle is folded.

8. A hip or ridge cap shingle as claimed in claim 7 wherein the ribbon of reinforcing material is position to extend on either side of a line between the notches to correspond to the location of the bullnose edge when the shingle is folded.

9. A hip or ridge cap shingle as claimed in claim 1 further comprising a third fold line extending longitudinally along the shingle body to aid in folding the shingle along the third fold line to conform the shingle to the shape of a ridge or hip.

10. A shingle blank configured to be folded to form a multi-layer exposed portion having a bullnose edge, the shingle blank comprising:

an elongated body having a top, a bottom, a front portion, a back portion, and an intermediate portion between the front portion and the back portion;

a first weakened fold line formed across the elongated body to accommodate folding of the elongated body transversely along the first weakened fold line to form a two-layer forward portion;

a second weakened fold line formed across the elongated body and spaced from the first weakened fold line to accommodate folding of the two-layer forward portion transversely along the second weakened fold line to form a four-layer forward portion with a two-layer bullnose edge; and at least one ribbon of reinforcing material formed across the elongated body and positioned to extend around and reinforce the bullnose edge.

11. A bullnose ridge or hip cap shingle comprising;

a forward portion to be exposed when a plurality of like bullnose ridge or hip cap shingles are installed along a ridge or hip;

a rear portion to be overlapped by the forward portion of a like bullnose ridge or hip cap shingle when a plurality of ridge or hip cap shingles are installed along a ridge or hip;

the forward portion comprising multiple layers of overlapping shingle material terminating in a multiple layer folded bullnose edge of shingle material; and a ribbon of reinforcing material extending around the folded bullnose edge to provide reinforcement and crack resistance.

* * * * *